US008435401B2

(12) United States Patent
Tyler et al.

(10) Patent No.: US 8,435,401 B2
(45) Date of Patent: May 7, 2013

(54) FLUIDIZED CATALYTIC CRACKER WITH ACTIVE STRIPPER AND METHODS USING SAME

(75) Inventors: A. Lamont Tyler, Salt Lake City, UT (US); Vincent J. Memmott, Centerville, UT (US); John A. Paraskos, San Rafael, CA (US); James R. Vemich, Bountiful, UT (US)

(73) Assignee: Process Innovators, Inc., Salt Lake City, UT (US)

( * ) Notice: Subject to any disclaimer, the term of this patent is extended or adjusted under 35 U.S.C. 154(b) by 650 days.

(21) Appl. No.: 12/349,408

(22) Filed: Jan. 6, 2009

(65) Prior Publication Data

US 2010/0174125 A1 Jul. 8, 2010

(51) Int. Cl.
*C07C 4/06* (2006.01)

(52) U.S. Cl.
USPC ..... 208/113; 208/153; 208/155; 208/161; 422/142; 422/600; 422/609

(58) Field of Classification Search ..... 585/311, 585/312; 422/142, 600, 609; 208/113, 153, 208/155, 161
See application file for complete search history.

(56) References Cited

U.S. PATENT DOCUMENTS

| | | | | |
|---|---|---|---|---|
| 2,883,332 | A | 4/1959 | Wickham | |
| 2,900,324 | A | 4/1959 | Patton et al. | |
| 3,008,896 | A | 11/1961 | Lawson | |
| 3,964,876 | A | 6/1976 | James | |
| 4,424,116 | A | 1/1984 | Hettinger | |
| 4,572,780 | A | 2/1986 | Owen et al. | |
| 4,863,585 | A | 9/1989 | Herbst et al. | |
| 4,925,632 | A * | 5/1990 | Thacker et al. | 422/142 |
| 4,990,314 | A | 2/1991 | Herbst et al. | |
| 4,999,100 | A | 3/1991 | Thacker et al. | |
| 5,059,305 | A | 10/1991 | Sapre | |
| 5,128,109 | A | 7/1992 | Owen | |
| 5,284,575 | A | 2/1994 | Owen | |
| 5,314,610 | A | 5/1994 | Gartside | |
| 5,316,662 | A | 5/1994 | Cetinkaya | |
| 5,380,426 | A | 1/1995 | Johnson et al. | |

(Continued)

FOREIGN PATENT DOCUMENTS

| | | |
|---|---|---|
| CN | 1185477 | 6/1998 |
| GB | 1387919 | 3/1975 |

(Continued)

OTHER PUBLICATIONS

Arajulo-Monroy, C. and Felipe Lopez-Isunza; Modeling and Simulation of an Industrial Fluid Catalytic Cracking Riser Reactor Using a Lump-Kinetic Model for a Distinct Feedstock; ACS Publications; Ind. Eng. Chem. Res.; 2005; vol. 45, No. 1; http://pubs.acs.org.

(Continued)

*Primary Examiner* — Brian McCaig
(74) *Attorney, Agent, or Firm* — Workman Nydegger

(57) ABSTRACT

A staged fluidized catalytic cracker and method for cracking a hydrocarbonaceous material includes a plurality of staged reactors that have catalyst particles flowing in series from one reactor to the next and hydrocarbon feed that is delivered in parallel to the reactors. Between each reactor the partially spent catalyst is actively stripped to partially reactivate the catalyst. Once the catalyst is fully spent in the final reactor the catalyst can be oxidatively regenerated.

15 Claims, 6 Drawing Sheets

U.S. PATENT DOCUMENTS

| | | | |
|---|---|---|---|
| 5,498,326 | A | 3/1996 | Galtier et al. |
| 5,565,177 | A | 10/1996 | Cetinkaya |
| 5,716,585 | A | 2/1998 | Senegas et al. |
| 5,858,207 | A | 1/1999 | Lomas |
| 6,248,298 | B1 | 6/2001 | Senior et al. |
| 6,267,873 | B1 | 7/2001 | Das et al. |
| 7,029,571 | B1 | 4/2006 | Bhattacharyya et al. |
| 7,261,807 | B2 | 8/2007 | Henry et al. |
| 2004/0121898 | A1 | 6/2004 | Mayes |
| 2004/0182747 | A1 | 9/2004 | Chen et al. |
| 2005/0163674 | A1 | 7/2005 | Letzsch |
| 2006/0108260 | A1 | 5/2006 | Henry |
| 2007/0251863 | A1 | 11/2007 | Cunningham et al. |

FOREIGN PATENT DOCUMENTS

| | | |
|---|---|---|
| JP | 56-004686 | 1/1981 |
| JP | 06-313176 | 11/1994 |
| JP | 10-195454 | 7/1998 |
| JP | 11-043678 | 2/1999 |
| JP | 2007-177193 | 7/2007 |

OTHER PUBLICATIONS

UOP Fluid Catalytic Cracking (FCC) and Related Processes; www.uop.com.

* cited by examiner

FLUIDIZED CATALYTIC CRACKER WITH ACTIVE STRIPPER AND METHODS USING SAME

BACKGROUND OF THE INVENTION

1. The Field of the Invention

The present invention relates generally to fluidized catalytic crackers and methods for upgrading hydrocarbons using novel fluidized catalytic crackers. More particularly, the present invention relates to a staged fluidized catalytic cracker that has a plurality of reactors that are fed fluidized catalyst in series and where an active stripper is positioned between each reactor to strip the fluidized catalyst between reactors.

2. The Related Technology

Catalytic cracking is the backbone of many refineries. It converts heavy feeds into lighter products by catalytically cracking large molecules into the smaller molecules that are found in highly valued transportation fuels. Catalytic cracking operates at low pressures, without significant hydrogen addition, in contrast to hydrocracking, which operates at high hydrogen pressures.

The most widely used process for catalytic cracking is fluidized catalytic cracking. In fluidized catalytic cracking (FCC), a catalyst, having particle sizes between about 20-100 microns circulates between a cracking reactor and a catalyst regenerator. In the reactor, hydrocarbon feed contacts hot, regenerated catalyst. The hot catalyst vaporizes and cracks the feed at 800-1100° F. (425-600° C.), usually 860-1040° F. (460-560° C.). The cracking reaction deposits carbonaceous hydrocarbons, which eventually turn to coke on the catalyst, thereby deactivating it. The cracked products are separated from the coked catalyst, usually with the aid of a catalyst stripper, and the stripped catalyst is then regenerated within the regenerator. A catalyst regenerator burns coke from the catalyst with oxygen containing gas, usually air. Regeneration of the catalyst by oxidation restores catalyst activity and simultaneously heats the catalyst to, e.g., 930-1650° F. (500-900° C.), usually 1110-1380° F. (600-750° C.). This heated catalyst is recycled to the cracking reactor to crack more fresh feed. Flue gas formed by burning coke in the regenerator may be treated for removal of sulfur oxides, nitrogen oxides, and particulates and for oxidation of carbon monoxide, after which the flue gas is normally discharged into the atmosphere. Catalytic cracking is an endothermic reaction. The heat for cracking and vaporization of the feed is supplied at first by the hot regenerated catalyst from the regenerator. In actuality, it is a portion of the feed that becomes coke which, when oxidized, provides the heat needed to crack the feed.

Catalytic cracking has undergone much development since its introduction over fifty years ago. The trend of development of the FCC process has been to use riser cracking with zeolite catalysts. Zeolite based catalysts of high activity and selectivity are now used in most FCC units. These catalysts have allowed refiners to increase throughput and conversion, compared to operation with amorphous catalysts. Use of zeolite catalysts effectively debottlenecked the reactor section, especially when a riser reactor was used.

Today, regenerators operate at very high temperatures. Most FCC units are heat balanced; the endothermic heat of cracking is supplied by burning the coke deposited on the catalyst. With poorer feeds, more coke is deposited on the catalyst than is needed for the cracking reaction. The regenerator operates at higher temperatures and excess heat is emitted in the form of high temperature flue gas. Regenerator temperature now limits many refiners in the amount of residue or high carbon residue feeds which can be tolerated by the unit. Special coolers to moderate the heat produced in regerators have become more common as deeper cuts of petroleum are fed to catalytic crackers.

BRIEF SUMMARY OF THE INVENTION

The present invention is directed to a staged fluidized catalytic cracker (FCC unit) and method for cracking a hydrocarbonaceous material. The FCC unit of the invention includes a plurality of staged reactors that have catalyst particles flowing in series from one reactor to the next and hydrocarbon feed that is delivered in parallel to the reactors. Between reactors, the catalyst is stripped using an active stripper. Surprisingly, active stripping of the catalyst between reactors has been found to have a profound impact on the activity of the catalyst in the second reactor and any subsequent reactors. Testing using active stripping in the staged FCC unit of the invention has shown that active stripping between reactors improves yields of the desired products and allows an operator to adjust process conditions to achieve desired conditions within the reactor.

In one embodiment of the invention, the FCC unit includes a first reactor, a second reactor, and optionally any number of additional reactors. Each reactor has one or more inlets for receiving a hydrocarbon feedstock and a cracking catalyst. Each reactor also has one or more outlets for discharging the cracking catalyst and the cracked hydrocarbons.

The FCC unit also includes a hydrocarbon stripping vessel in fluid communication with an outlet of the first reactor for receiving the catalyst after it is partially spent. In the stripping vessel, stripping gases are injected through the catalyst bed. The action of the stripping gas moving through the catalyst bed removes cracked hydrocarbons, which are discharged from the FCC unit with the stripping gas. This stripping action rejuvenates the catalyst to some extent and significantly improves catalytic performance compared to previous FCC units.

An active stripper is positioned within the stripping vessel. The active stripper is positioned in a region of the stripping vessel where the stripping gas and the partially spent catalyst come into contact. The active stripper has a plurality of structures with features that enhance stripping of the partially spent catalyst. Examples of suitable structures for actively stripping the catalyst include plates, rings, caps, particulate, trays, packing, wire and the like.

The enhanced stripping is typically caused by turbulence and/or contact between the catalyst particles, the stripping gas, and the structural features of the active stripper. The active stripping partially reactivates the catalyst by removing a significant portion of the labile hydrocarbonaceous deposits from the catalyst—in addition to removing hydrocarbons and sweeping the hydrocarbons from between the fluidized catalyst particles.

In one embodiment, the inlet for the stripping gas is a distribution plate with a plurality of nozzles and the active stripper is positioned above the nozzles so as to be within the flow pattern and/or spray pattern of the gases ejected from the nozzles. This configuration of the active stripper is particularly advantageous for partially reactivating the catalyst by, for example, removing coke deposits.

The stripping vessel is also in fluid communication with an inlet of the second reactor for feeding partially spent catalyst to the second reactor after it has been stripped in the active stripper. The partially regenerated catalyst from the active stripper is more active and thus produces higher yields in the second and subsequent reactors than would otherwise be achieved in a serial conventional system. After flowing through the second reactor, the catalyst can be fed to any number of subsequent stripping vessels and/or reactors until the catalyst is fully spent or near fully spent. The spent catalyst is then delivered to a regenerator.

The FCC unit includes a regenerator configured to receive the fully spent catalyst from the last reactor and regenerate the catalyst for reuse in the first reactor. One or more strippers (active and/or non-active strippers) can be positioned immediately before the regenerator. The catalyst is typically regenerated and recycled through the FCC unit numerous times before it is replaced. The catalyst is typically replaced at a fixed rate that depends on a number of factors such as poisons in the feed, thermal degradation of the catalyst activity, and/or selectivity maintenance, and the like.

The present invention also includes a method for upgrading a hydrocarbonaceous material. The method includes the following steps: a) passing hot regenerated catalyst particles from a catalyst regenerator to the bottom portion of a first reactor and injecting a first portion of a hydrocarbon feedstock into the reactor with the catalyst particles; b) passing the catalyst particles and the first feed portion up through the first reactor and into a stripping vessel, whereby the first feed portion is cracked and the catalyst particles are partially spent in the first reactor; c) separating the cracked first feed portion from the catalyst particles and discharging the cracked first feed portion, wherein the separation is at least partially carried out by passing the catalyst particles through an active stripper; d) passing the catalyst particles from the first reactor vessel to the bottom portion of a second reactor and injecting a second portion of the hydrocarbon feedstock into the second reactor; e) passing the catalyst particles and second feed portion up through the second reactor and into a second stripping vessel whereby the second feed portion is cracked and the catalyst particles are further spent; f) separating the cracked second feed portion from the catalyst particles and discharging the cracked second feed portion; and g) returning the catalyst particles to the regenerator and regenerating the catalyst particles. Optionally, a third, fourth, or even more additional reactors can be included and can have active strippers therebetween.

Stripping the partially spent catalyst between stages of a staged catalytic process allows for significantly different process conditions in the downstream stages compared to staged reactor systems where the catalyst is only stripped after the final stage. This is in contract to the methods known in the prior art where stripping is performed before the regenerator to maximize the recovery of the final hydrocarbon product and/or to reduce heat production in the catalyst regeneration unit. (Although known FCC systems use stripping, known FCC systems do not strip between reactors).

The use of the active stripper in the stages of the catalytic cracking unit has a significant positive effect on the activity of the catalyst in the second reactor and subsequent reactors. The partial reactivation of the catalyst is in addition to the removal of hydrocarbons, which would be expected with stripping. As described above, coke deposits are undesirable because they reduce catalytic activity. However, coke buildup is unavoidable and is needed to heat the catalyst in the regeneration unit. Partially reactivating the catalyst between reactors has a substantial impact on the FCC process. One effect is that active stripping substantially delays the complete deactivation of the catalyst to a later point in the catalyst cycle in the FCC unit. This delay results in higher yields and allows better control of cracking in individual reactors. For example, in the first reactor, hard-to-crack materials, including lighter feedstocks such as naphthas with boiling ranges from 100° F. to 400° F. (38° C. to 204° C.) can be cracked while only partially deactivating the catalyst. This allows other higher coking materials to be cracked in downstream reactors with high conversion rates.

The improved catalytic performance of the actively stripped catalyst can also allow for a higher catalyst-to-oil ratio in the reactor. All things being equal, a higher catalyst-to-oil ratio results in faster cracking rates, but with increased coking. However, because the active stripping partially reactivates the catalyst particles, the higher catalyst to oil ratio can be used without disrupting reaction conditions or thermal equilibrium. In one embodiment of the invention, high conversion rates are achieved by using a catalyst to oil ratio in a range from about 12 to about 40, and more preferably in a range from about 15 to about 30, with a staged FCC unit having one or more intermediate active strippers.

These and other advantages and features of the present invention will become more fully apparent from the following description and appended claims as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF EMBODIMENTS OF THE INVENTION

I. Staged Fluidized Catalytic Cracking Unit

Embodiments of the invention are directed to a fluidized catalytic cracking unit that includes two or more staged reactors that have catalyst particles flowing in series from one reactor to the next and hydrocarbon feed that is delivered in parallel to the reactors. Between reactors, the catalyst is stripped using an active stripper. The active stripper includes a plurality of structures (e.g., plates or packing) that are positioned within the flow of a stripping gas so as to increase the contact between the structures and the catalyst, thereby facilitating stripping. The active stripping can be implemented in any type of staged FCC unit where catalyst flows in series and hydrocarbon feed is delivered in parallel to the reactors. Examples of suitable reactor types that can be used in accordance with the present invention include low profile FCC units, such as those described in U.S. Pat. No. 4,999,100, and staged vertical FCC units, such as those described in U.S. Pat. No. 5,314,610, both of which are incorporated herein by reference.

Figure 1:
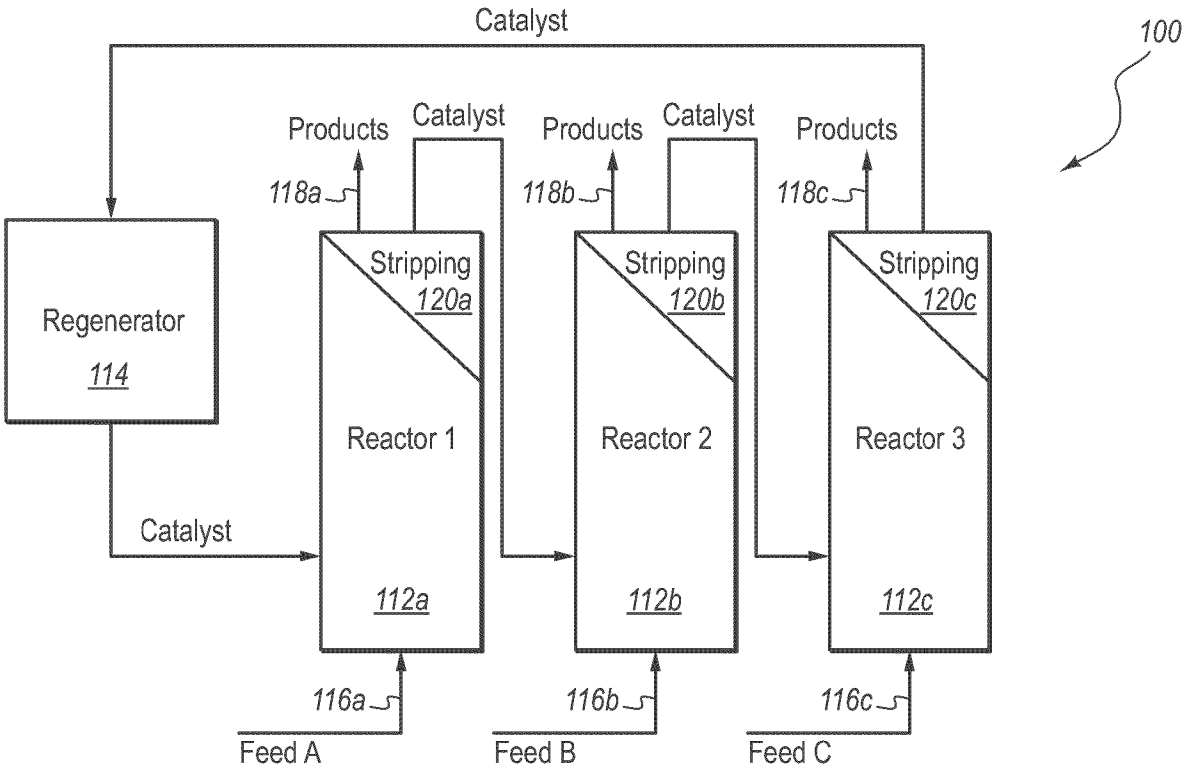
FIG. 1 is a schematic representation of a staged fluidized catalytic cracking unit according to one embodiment of the invention.

FIG. 1 is a schematic representation of a staged fluidized catalytic cracking (FCC) unit 100 according to one embodiment of the invention. The staged FCC unit 100 includes first, second and third reactors, 112*a*, 112*b*, and 112*c* respectively. A regenerated catalyst from regenerator 114 is fed into first reactor 112*a* along with a first hydrocarbon feed 116*a* under fluidized catalytic cracking conditions. Hydrocarbon feed 116*a* is broken down into catalytically cracked first products 118*a* and a partially spent catalyst. The fluidized catalytic cracking in first reactor 112*a* is carried out under conditions that do not result in a fully spent catalyst. Thus, cracking conditions in first reactor 112*a* are optimized without the need to ensure coke levels high enough to provide sufficient fuel for a regeneration unit to heat the catalyst to the required first reactor inlet temperature. This is in contrast to fluidized catalytic cracking systems that do not have additional reactors downstream from a first reactor, which require proper coking for regeneration of the catalyst by oxidation of the coke.

The partially spent catalyst is then fed through an active stripping vessel 120*a* (also referred to as "active stripping compartment") and stripped of hydrocarbons. The hydrocarbon product 118*a* is collected and used or transported and/or further processed using refining techniques known in the art. It has been found that active stripping accomplishes more than just effectively removing hydrocarbon product. The active stripping also restores a significant portion of the activity lost in first reactor 112*a*.

The partially reactivated catalyst from active stripping vessel 120*a* is then introduced into the second reactor 112*b* along with a second hydrocarbon feed 116*b* under fluidized catalytic cracking conditions. Second hydrocarbon feed 116*b* is broken down into catalytically cracked second products 118*b* and the catalyst is further spent. Since this particular embodiment includes three stages of reactors, the cracking conditions in the second reactor 112*b* would typically produce a partially spent catalyst that can be partially reactivated for use in third reactor 112*c*. However, the present invention also includes embodiments with two stages, in which the second stage would typically produce a fully spent catalyst suitable for regeneration in regenerating unit 1.

The partially spent catalyst from second reactor 112*b* is then fed through a second active stripping vessel 120*b* and stripped of hydrocarbons. The second hydrocarbon product 118*b* is collected and used or transported and/or further processed using refining techniques known in the art.

In yet a third stage, the partially reactivated (i.e., reactivated from the activity lost in second reactor 112*b*) is introduced into a third reactor 112*c* with a third hydrocarbon feed 116*c* under fluidized catalytic cracking conditions and partially or fully spent. The partially or fully spent catalyst from reactor 112*c* can optionally be fed through active stripping vessel 120*c* where hydrocarbons are removed. The partially or fully spent catalyst from stripping vessel 120*c* is then returned to the regenerating unit 114 to be regenerated in an oxidative process (i.e., the coke is burned off to heat the catalyst to a desired temperature).

As discussed more fully below, hydrocarbon 116*a*, 116*b*, and 116*c*, can be the same or different and the catalytic cracking conditions in reactors 112*a*, 112*b*, 112*c*, can be the same or different.

The staged fluidized catalytic cracking unit of the invention can have any configuration that allows for cracking a plurality of feeds using a plurality of reactors while actively stripping partially spent catalyst between the fluidized reactors. The plurality of fluidized catalytic cracking reactors can be separate vessels, as illustrated in FIG. 1, or the reactors can be part of a single vessel. The reactors can be positioned horizontally or vertically or both. An example of a low profile staged reactor design is described in U.S. Pat. No. 4,999,100 to Thacker, which is hereby incorporated by reference. An example of a vertically staged FCC reactor is described in U.S. Pat. No. 5,314,610 to Gartside, which is hereby incorporated by reference.

Figure 2:
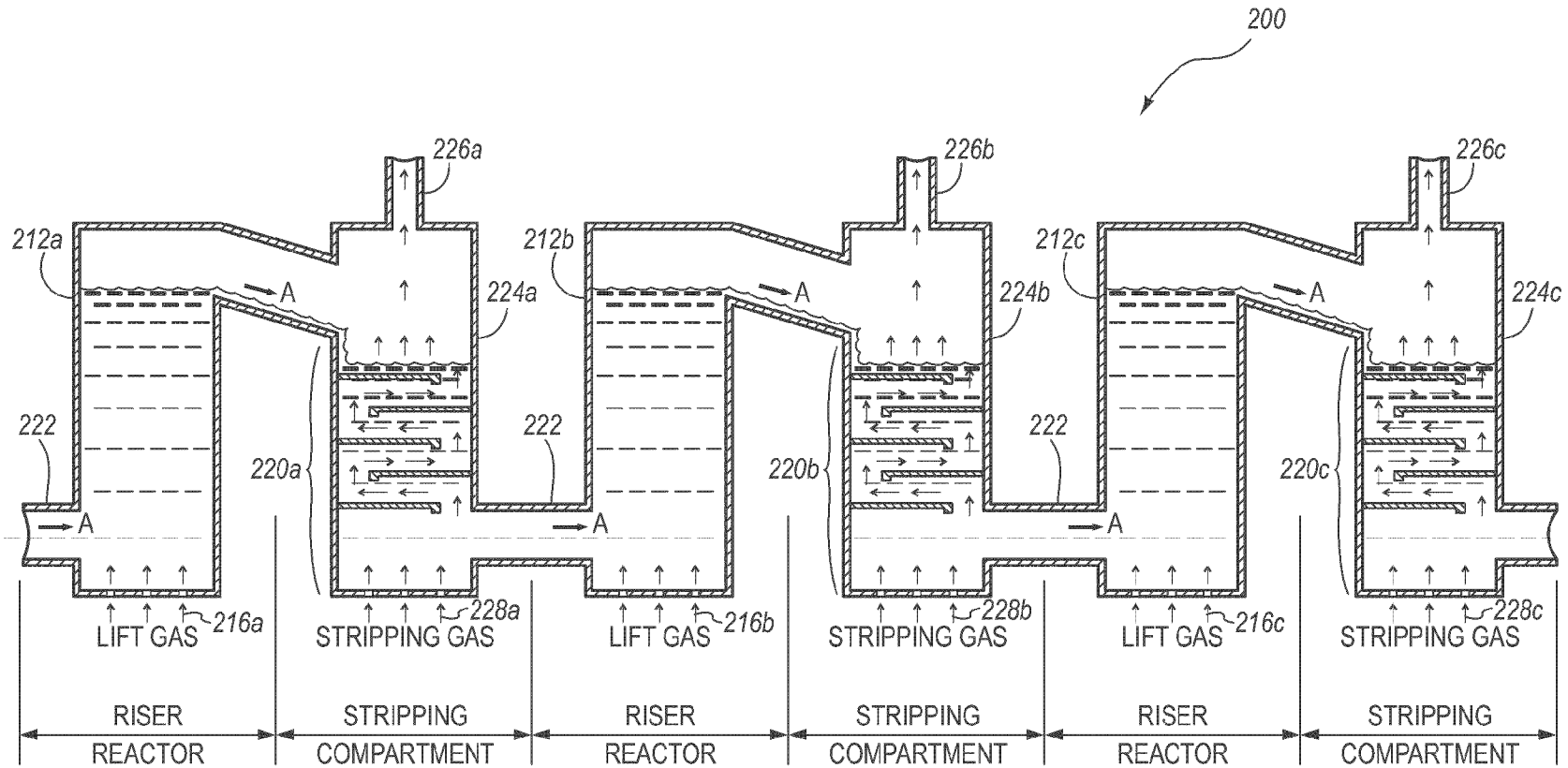
FIG. 2 is a schematic, cross-sectional view of a low-profile staged catalytic cracking unit according to one embodiment of the invention.

FIG. 2 illustrates a low-profile staged FCC unit 200 according to one embodiment of the invention. The low-profile staged FCC unit 200 includes a plurality of reactors 212*a*, 212*b*, and 212*c*. The first reactor 212*a* has an inlet 222 for receiving a hot, clean, freshly regenerated catalyst. The catalyst can be delivered directly from a regenerator or alternatively the catalyst can be delivered through stripping section (not shown) where stripping steam is introduced and then into the lower end or reactor 212*a*. A first hydrocarbon feed 216*a* is injected into the lower end of reactor 212*a* in the form of a lift gas. The lift gas can include gases other than gaseous hydrocarbons, including but not limited to steam. As will be discussed later, the first hydrocarbon feed 216*a* can be the lightest fraction, such as the naphtha fraction, of the total hydrocarbon feed, if a feed profile is used.

The expanding gases from the feed (and the fluidizing medium if present) convey the catalyst up the reactor 216*a*. As the catalyst and feed pass up the reactor under fluidized catalyst cracking conditions, the hydrocarbon feed cracks into lower boiling hydrocarbon products. The ratio of catalyst to hydrocarbon feed in the reactor 212*a* can be within a range from about 3 to about 40 (weight of catalyst per weight of feed). The reactor 212*a* discharges the catalyst and cracked hydrocarbon into a separation zone, which is provided by vessel 224*a*. The direction of the flow of the catalyst through the low-profile staged FCC unit, including vessel 224, is indicated by the arrow labeled "A."

In the separation zone, the majority of the solids are separated from the gases. Partially spent catalyst is allowed to fall toward the bottom of the vessel 224*a*. Separated gaseous products are collected and removed from product outlet 226*a* in the top of vessel 224*a*. While the embodiment illustrated in FIG. 2 shows the separation zone in vessel 224*a* as being open to the top of reactor 212*a*, those skilled in the art will recognize, that these two vessels can be more discrete vessels with the catalyst and/or products being delivered to the separation vessel 224 using known techniques.

The separation vessel 224*a* also includes an active stripper 220*a*. The active stripper 220*a* includes a plurality of structures (one of which is labeled 226*a*) that are positioned within the flow of the catalyst and within the flow of a stripping gas 228*a*.

The active stripper structures can be any material shaped and sized to provide a surface area that significantly increases the collisions the catalysts particles have as they travel through active stripper 220*a*. The particles of catalyst are typically caused to collide with stripping gas, one another, and with the surface of the active stripper structures. The active stripper structures can be a packing material or other shaped structures such plates, rings, caps, particulate, trays, packing, wire, including, but not limited to, sieve trays, baffling, shaped rods, balls, bubble cap trays, packing material such as rings, saddles, shaped cylinders, particulate materials, and or fibrous materials such as steel wool. Any material can be used to make the structures so long as the material is compatible with the conditions within the active stripper (i.e., compatible with the temperature, hydrocarbons, catalyst, etc. within the active stripper).

Figure 3B:
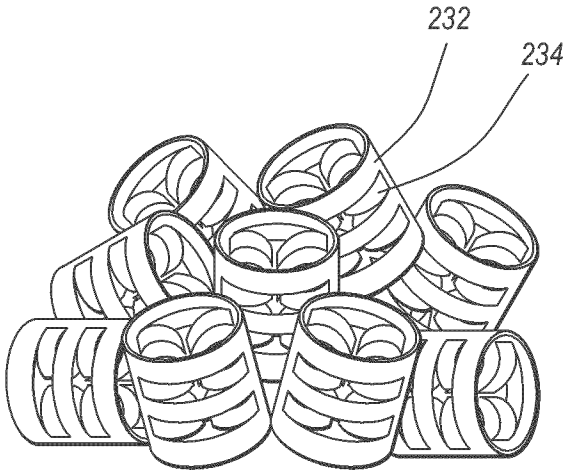
FIGS. 3 and 3B illustrate example packing material that can be used in the active stripper of the staged FCC unit of FIG. 2.

FIGS. 3A and 3B illustrate example active stripping structures that can be placed in a vessel to increase the stripping of hydrocarbons from the fluidized catalyst and partially reactivating the catalyst. FIG. 3A illustrates a perforated, ribbed metal plate 230 that can be sized to span the width of the active stripper. FIG. 3B illustrates a cylindrical packing material 232 that has punched out regions 233 of the cylinder to further increase the disruption that the structures have on the flow of catalyst particles moving through the active stripper.

Figure 4B:
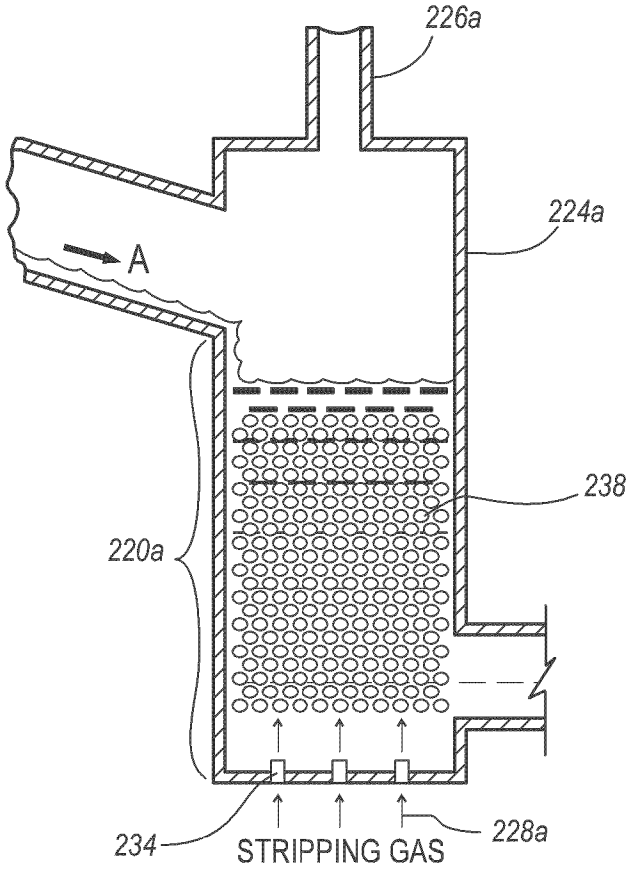
FIGS. 4A and 4B illustrates a compartment of an FCC unit according to the invention that includes an active stripper.
Figure 4A:
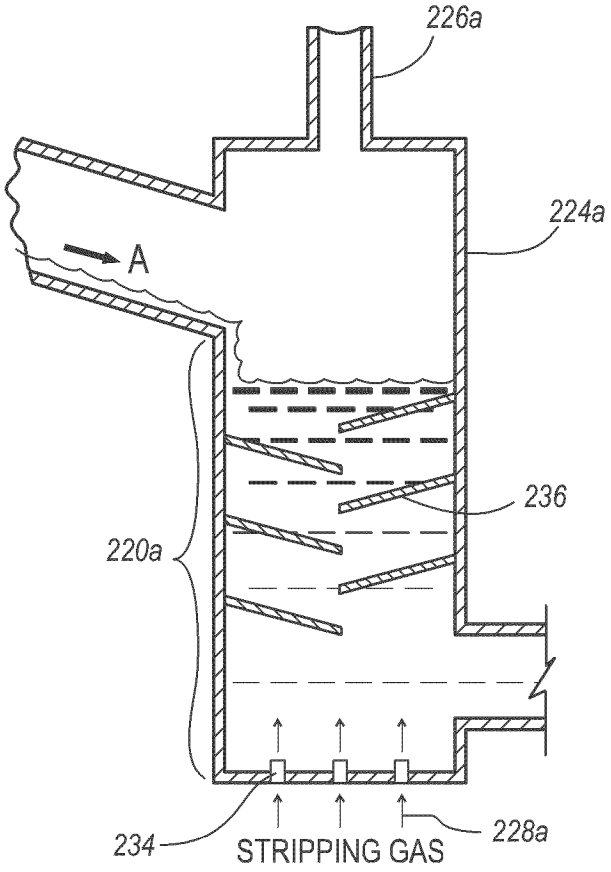

FIGS. 4A and 4B illustrate alternative embodiments showing structures positioned within vessel 224*a* to form an active stripper. FIG. 4 shows slanted plates 236 within active stripper 220*d*. FIG. 4B shows a particulate 238 that forms active stripper 220*e*.

To increase the collisions of catalyst particles moving through the active stripper 220*a*, a stripping gas 228*a* is injected into the active stripper counter to the flow of the catalyst. The stripping gas fluidizes the catalyst, which allows the particles to flow through the active stripper at a desired rate. The fluidization in the stripping vessel 224*a* is typically less compared to the fluidization in reactor 212*a* to ensure that the catalyst flows in the desired direction (i.e., from reactor 212*a* to the stripping vessel 224*a*). The stripping gas can be introduced into the bottom of vessel 224*a* using any known technique. FIGS. 4A and 4B show a plurality of nozzles 233 that can be used to spray the stripping gas up through the catalyst and active stripper 220*a* (e.g. using a distribution plate).

With reference again to FIG. 2, as the fluidized catalyst drops through active stripper 220*b*, hydrocarbons are removed from the catalyst and collected through port 226*a*. In addition, the active stripping partially reactivates the catalyst. It has been found that the active stripping is primarily responsible for the partial reactivation of the catalyst in vessel 224*a*. This is in contrast to hydrocarbon stripping that is passive (i.e., merely stripping using a stripping gas, but little or no active stripping structures).

The partially reactivated catalyst from vessel 224*a* is discharged to reactor 212*b*. The catalytic activity of the catalyst discharged from vessel 224*a* is sufficiently high that the catalyst is not regenerated using oxidative treatments (i.e., the catalyst from vessel 224*a* is not delivered to a regeneration unit such as regeneration unit 14 shown in FIG. 1). In reactor 212*b*, a second feed 216*b* is injected concurrent with the partially reactivated catalyst from vessel 224*a*. Reactor 212*a* is maintained under catalytic cracking conditions to cause the catalytic cracking of hydrocarbons in feed 216*b* into lighter, more valuable hydrocarbons. During the catalytic cracking of hydrocarbons in reactor 212*b*, the catalyst is further deactivated (i.e., partially spent). The further spent catalyst from reactor 212*b* is discharged to separation vessel 224*b* and active stripper 220*b* where active stripping and separation of catalyst from hydrocarbons is carried out in a similar manner as described above for separation vessel 224*a*. During active stripping of the catalyst in active stripper 220*b*, the catalyst is again partially reactivated. However, with each successive reactor the catalytic activity will typically diminish despite the partial reactivation from the active stripper.

Partially reactivated catalyst from separation vessel 224*b* is introduced into reactor 212*c* along with a third hydrocarbon feed 216*c* and under catalytic cracking conditions. The process for cracking and optionally active stripping can be carried out in the final reactor and separation vessel in a manner similar to that described above with respect to reactor 212*b* and separation vessel 224*b*.

Following catalytic cracking in reactor 212*c*, and optionally stripping in stripper 220*c*, the catalyst is essentially spent. Spent catalyst is delivered to a regenerator where it is heated to burn off coke and to regenerate the catalyst. While the catalyst sent to the regenerator may have an insignificant amount of catalytic activity, those skilled in the art are familiar with the amount of catalytic activity that results in a catalyst being essentially spent (i.e., the catalytic activity is essentially to low for its use to be economically valuable).

In the regenerator, air or oxygen or a mixture thereof is introduced and coke is removed from the catalyst by combustion with the oxygen. The combustion by-products typically rise upwardly along with any entrained catalyst and into a cyclone separator where the catalyst is recovered for continued use in the FCC unit. The burning of the coke heats the catalyst back up to the required cracking temperature and the catalyst is then once again introduced into the first catalytic cracking reactor 212*a*.

The present invention is not limited to any particular number or repeating stages of catalytic cracking and active stripping vessels so long as at least one active stripper is positioned between the two reactors and the catalyst is not regenerated by an oxidative process between the first and second reactor. However, it can be preferred to have at least three stages to benefit from the differing conditions that can be used for catalytic cracking in three or more stages. Moreover, for staged FCC Units with three or more stages, it is preferably to actively strip the catalyst after each reactor, but not required.

II. Catalytic Cracking Conditions

The catalytic cracking conditions used in the staged FCC unit of the present invention will depend on a number of factors, including the particular type of catalyst and the particular feedstock being used. The present invention can be carried out using traditional catalysts for fluidized catalytic cracking of hydrocarbons. In addition, any hydrocarbon feedstock suitable for cracking in a traditional catalytic cracker can be cracked in the staged FCC unit of the present invention. Those skilled in the art are familiar with adjusting process conditions to account for the differences in hydrocarbons and catalyst that have traditionally been used in fluidized catalytic cracking processes.

The conditions in the staged FCC units of the present invention can also be optimized to improve the yields of high value products in ways that cannot be done in traditional FCC units and even staged FCC units lacking the active stripper. The total reaction in any fluidized catalytic cracking is a summation of thermal and catalytic reactions. Thermal reactions are driven by temperature and catalytic reactions are a function of both temperature level and the number and strength of the catalytic sites. The active stripping carried out in the staged FCC unit of the present invention increases the catalytic sites in catalyst, which increases the catalytic sites on the catalyst for all the reactors downstream from the active stripper. This reactivation results in higher catalytic activity and allows the reaction conditions in those reactors to be adjusted accordingly.

In one embodiment of the invention, catalytic cracking is favored over thermal cracking by using a relatively high catalyst to oil ratio. With a higher catalyst to oil ratio (C/O) at a given heat balance, there will be a greater amount of catalytic reactions compared to thermal reactions. Furthermore, there will be higher conversions at any given temperature. The catalytic reactions are preferred since they provide isomerization and result in the desired $C_3$ olefins and iso $C_4$ and $C_5$ compounds as opposed to the thermal reaction products of $C_2$ and lighter compounds. The C/O ratio in each individual reactor can typically be in a range from 3 to 40, but is preferably at least greater than about 8, more preferably greater than about 12, and even more preferably greater than about 15 and most preferably greater than 24.

The use of the active stripper allows for these higher local C/O ratios. Because the active stripper partially reactivates the catalyst, the C/O ratio can be increased while maintaining the same activity over a period of time. Alternatively, the increased activity caused by active stripping can be advantageous for increasing the number of staged reactors in the FCC unit.

Since there is independent staging with only a portion of the total feed going to each stage and with product removal from each stage, it can be seen that the amount of feed to each stage is small as compared to the amount of catalyst flowing through the system. Since the catalyst flows through the entire system the overall C/O will be one third of the individual stage C/O for a three stage system. This example assumes equal feed flow per stage. Variations in feed flow in each stage can be used without departing from the spirit of the invention.

The residence time for each of the separate feed can also be relatively short since the feed only passes through one stage (unlike a single riser system where the initial feed passes through all subsequent stages). The reduced residence time will reduce secondary hydrogen transfer reactions thus favoring the production of olefins and reducing the production of aromatics. Also, the shorter residence times reduce the degradation of product when operating at the higher temperatures which are used to maximize the olefin production. In a preferred embodiment, the residence time of the feed, defined as the volumetric flow rate of the exit gas divided by the reactor volume, is less than 2 seconds, more preferably less than 1.5 seconds, and most preferably less than 1 seconds.

The high catalyst activity due to active stripping, the high C/O ratio, and the short residence time means that the amount of thermal cracking is kept low compared to the amount of catalytic cracking. These improved conditions can be used to achieve higher conversions and higher catalytic content at the same temperature compared to a conventional system or alternatively, these improved conditions can be used achieve similar conversions at lower temperatures while minimizing thermal reactions.

Figure 5:
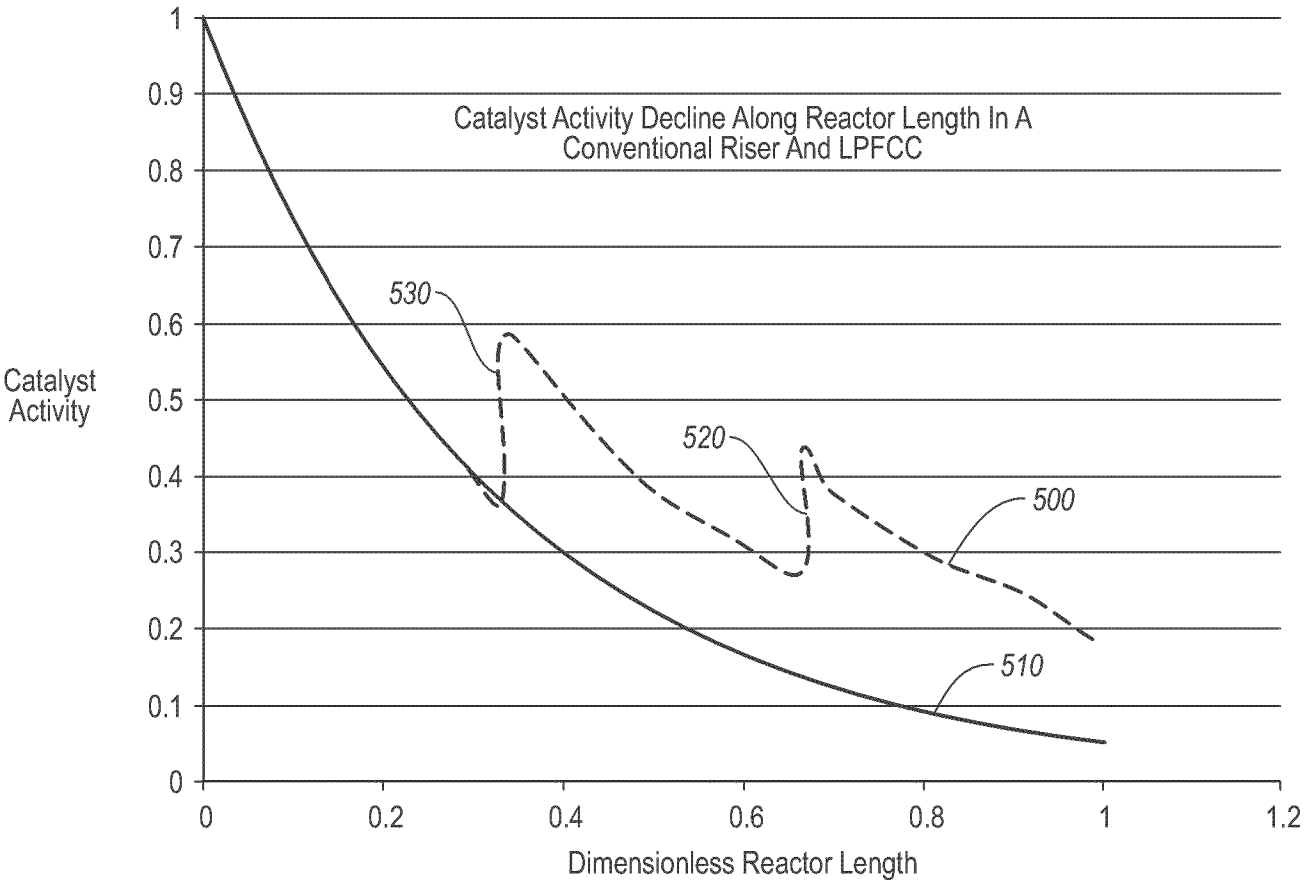
FIG. 5 is a graph showing the catalytic activity of a staged FCC unit having active strippers compared to a traditional FCC unit.

FIG. 5 illustrates the advantage of the staged catalytic cracker according to the invention compared to a conventional FCC cracker. The graph illustrates the catalyst activity (line 500) along the length of an example staged catalytic cracker (e.g., reactor 200) compared to the activity (line 510) along the length of a traditional FCC catalytic cracker. The activity line 500 includes reactivity spikes 520 and 530 where the catalytic activity was substantially improved by active stripping. As can be seen from activity lines 500 and 510, the activity of the catalyst that has been activity stripped is substantially higher over the length of a reactor compared to a traditional FCC reactor.

In another embodiment of the invention, the conditions in the staged FCC unit of the invention can be optimized by fractionating the whole feedstock and optimally delivering specific fractions to the different stages of the FCC unit. The processing conditions can be optimized, for example, by cracking hydrocarbons that are more difficult in the earlier staged reactors that have higher catalytic activity. In one embodiment, the fractionation of the feedstock is carried out by fractionating according to boiling point and the lower boiling fractions are processed in earlier stages of the FCC Unit than the heavier boiling fractions. Processing the lighter fractions first can be advantageous because the catalyst will retain more of its catalytic activity throughout the process since the heavier hydrocarbons are known to be coke precursors. In later stages, it can be desirable to use heavier feed fractions with the intent of coking the catalyst just before the regenerator to ensure that catalyst has sufficient coke to be reheated to a proper temperature in the regenerator. In one embodiment of the invention, the feed used in the FCC unit includes at least two fractions, more preferably at least three fractions. In one embodiment, the two or more fractions can be fractionated according to temperature. In one embodiment the feed oil is cut into two or more fractions within a range between 300° F. (148.9° C.) to the endpoint (e.g., 1200° F. [648.9° C.]).

V. Examples

Example 1

An FCC unit according to the present invention was used to crack a heavy feed. The feed was fractioned into Fraction A with a boiling point below 650° F. (343° C.) and Fraction B having a boiling point above 650° F. (343° C.). The FCC unit used to crack Fractions A and B was configured according to the schematic drawing shown in FIG. 1, which includes three catalytic cracking reactors with an active stripper positioned after each reactor. In accordance with the present invention, there was no oxidative regeneration between reactors (i.e., the regenerator is placed downstream of all three reactors). The reactors used were structurally similar to standard Advanced Cracking Evaluation Unit (Kayser Technology, Inc).

In the test runs equilibrium FCC catalyst was charged to the ACE reactor, then the light fraction (Fraction A) was fed into the reactor and the reaction carried out at temperature and a catalyst to oil ratio of approximately 12; then the reactor was stripped with nitrogen and the products collected during both reaction and stripping. The heavy fraction (Fraction B) was then fed into the second reactor at an approximate catalyst to oil ratio of 12 and then stripped once more in a similar fashion as the first stripping and the products collected for analysis.

Subsequently the process was repeated with the same catalyst in a simulation of a low profile FCC process. The reaction in each reactor was carried out similar to the ACE procedures. The test run was carried out by charging a fresh regenerated catalyst into the first reactor with Fraction A at a C/O ratio of approximately 12 and under cracking conditions. Hydrocarbon product was collected and the partially spent catalyst was stripped to partially reactivate the partially spent catalyst (hereinafter the "1× coked catalyst). The 1× coked catalyst was then used in a second run with a first portion of Faction B at a C/O ratio of about 12 and under cracking conditions. The hydrocarbon product from this reaction was collected and the catalyst was stripped to yield a partially spent, partially reactivated catalyst (hereinafter the "2× coked catalyst"). The 2× coked catalyst was then used in a third run with the second portion of Fraction B at a C/O ratio of about 12 under cracking conditions.

Figure 6:
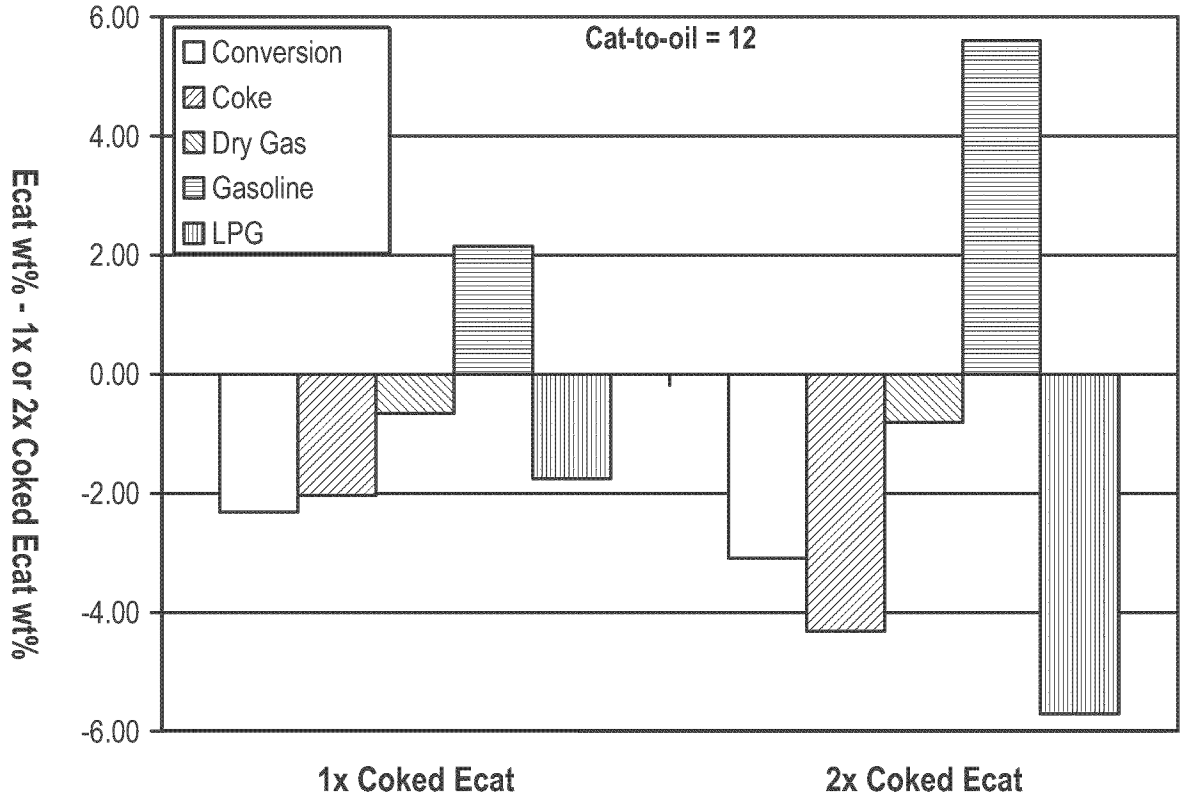
FIG. 6 is a graph showing the weight percent conversion of hydrocarbons using a process according to one embodiment.

Hydrocarbon product was collected from the third run and compared to the hydrocarbon product of the second run and the first run to evaluate the performance of the 1× coked catalyst with the 2× coked catalyst. FIG. 6 shows the weight percent of conversion, coke, dry gas, gasoline, and LPG for the 1× coked catalyst and the 2× coked catalyst compared to the fresh catalyst used in reactor 1.

As illustrated in FIG. 6, the catalytic activity of the partially reactivated 1× and 2× coked catalysts is surprisingly high as indicated in the high yields of valuable products such as gasoline. In addition to these results, the FCC unit of the invention resulted in surprisingly small quantities of bottoms, which are of little value. The high yields of valuable products and surprisingly low yields of low value bottoms results from the relatively high catalytic activity in the second and third reactors of the FCC unit. By actively stripping the partially spent catalyst after each reactor relatively high catalytic activity can be maintained even with a relatively high catalyst to oil ratio such as 12. High catalyst activity using heavy feed and a high catalyst to oil ratio is a surprising and unexpected result for a fluidized catalytic cracker.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for cracking a hydrocarbonaceous feedstock, the method comprising the steps of:

a) passing hot regenerated catalyst particles from a catalyst regenerator to the bottom portion of a first reactor and injecting a first portion of a hydrocarbon feed into the reactor with the catalyst particles;

b) passing the catalyst particles and the first feed portion up through the first reactor and into a first stripping vessel, whereby the first feed portion is cracked and the catalyst particles are partially spent in the first reactor;

c) separating the cracked first feed portion from the catalyst particles and delivering the cracked first feed portion into the first stripping vessel, wherein the separation is at least partially carried out by passing the catalyst particles through an active stripper including a plurality of active stripping structures;

d) passing the catalyst particles from the first stripping vessel to the bottom portion of a second reactor and injecting a second portion of the hydrocarbon feed into the second reactor;

e) passing the catalyst particles and second feed portion up through the second reactor and into a second stripping vessel whereby the second feed portion is cracked and the catalyst particles are further spent;

f) separating the cracked second feed portion from the catalyst particles and discharging the cracked second feed portion into the second stripping vessel; and g) returning the catalyst particles to the regenerator and regenerating the catalyst particles.

2. A method as in claim 1, wherein the active stripper comprises plates, rings, caps, particulate, trays, packing, wire, or a combination thereof.

3. A method as in claim 1, wherein a stripping gas is injected into the active stripper.

4. A method as in claim 3, wherein the stripping gas is injected into the active stripper using a distribution plate having a plurality of nozzles and the active stripper is positioned over the plate and within a flow pattern of gasses ejected from the nozzles.

5. A method as in claim 1, wherein the catalytic cracking vessels are positioned horizontal to one another so as to form a low profile FCC unit.

6. A method as in claim 1, wherein the catalytic cracking vessels are positioned vertically to one another.

7. A method as in claim 1, wherein the step of separating the cracked second feed from the catalyst particles comprises passing the catalyst particles through a second and subsequent active stripper.

8. The method of claim 7 wherein step (g) further includes the steps of passing the catalyst particles from the second stripping vessel to the bottom portion of a third reactor and injecting a third portion of the feed into the third reactor; passing the catalyst particles and the third feed portion up through the third reactor and into a third stripping vessel whereby the third feed portion is cracked and the catalyst particles are even further spent, and separating the cracked third feed portion from the catalyst particles and discharging the cracked third feed portion prior to returning the catalyst particles to the regenerator.

9. A method as in claim 1 wherein the catalyst to feed ratio in the first and second reactors is at least 8.

10. A method as in claim 1 wherein the catalyst to feed ratio in the first and second reactors is at least 12.

11. A method as in claim 1 wherein the catalyst to feed ratio in the first and second reactors is at least 15.

12. A method as in claim 1, wherein the first portion of the feed is a lighter weight hydrocarbon material than the second portion of the feed.

13. The method of claim 1 wherein the residence time of the first feed portion in the first reactor is different than the residence time of the second feed portion in the second reactor.

14. The method of claim 1 where the residence time in the first and second reactors is less than 2 seconds.

15. A method for cracking a hydrocarbonaceous feedstock, the method comprising the steps of:

a) passing hot catalyst particles to the bottom portion of a first reactor and injecting a first portion of a hydrocarbon feed into the reactor with the catalyst particles in a catalyst to oil ratio of at least 12;

b) passing the catalyst particles and the first feed portion up through the first reactor and into a first stripping vessel, whereby the first feed portion is cracked and the catalyst particles are partially spent in the first reactor;

c) in the first stripping vessel, separating the cracked first feed portion from the catalyst particles and discharging the cracked first feed portion, wherein the separation is at least partially carried out using steam and an active stripper including a plurality of active stripping structures, whereby the steam causes contact between the catalyst particles and the active stripper;

d) passing the catalyst particles from the first stripping vessel to the bottom portion of a second reactor and injecting a second portion of the hydrocarbon feed into the second reactor in a catalyst to oil ratio of at least 12;

e) passing the catalyst particles and second feed portion up through the second reactor and into a second stripping vessel whereby the second feed portion is cracked and the catalyst particles are further spent;

f) separating the cracked second feed portion from the catalyst particles and discharging the cracked second feed portion, wherein the separation is at least partially carried out using steam and an active stripper, whereby the steam causes contact between the catalyst particles and the active stripper.

* * * * *

UNITED STATES PATENT AND TRADEMARK OFFICE

CERTIFICATE OF CORRECTION

PATENT NO. : 8,435,401 B2
APPLICATION NO. : 12/349408
DATED : May 7, 2013
INVENTOR(S) : Tyler et al.

It is certified that error appears in the above-identified patent and that said Letters Patent is hereby corrected as shown below:

In the Drawings

Figure 3:
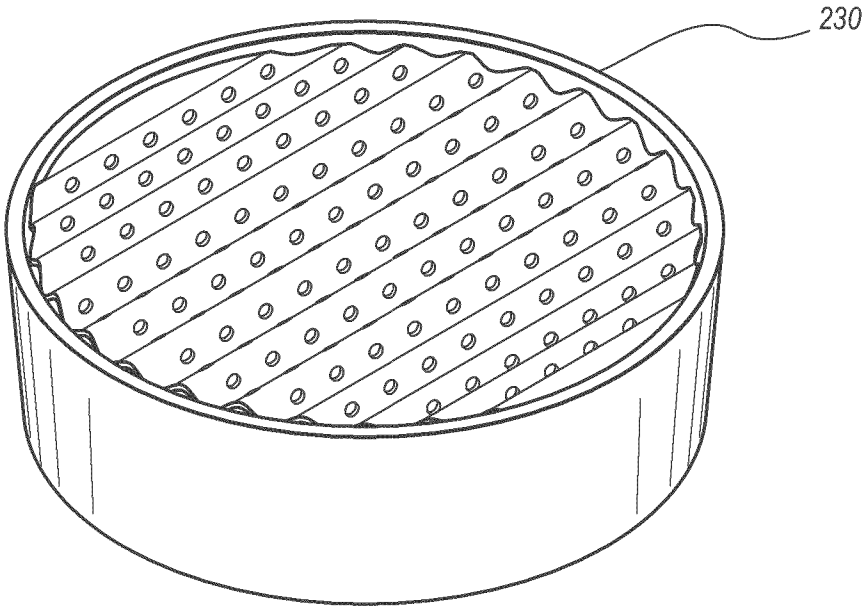

Sheet 3, replace Figure 3 with the figure depicted below, wherein Figure 3 is modified to say Figure 3A

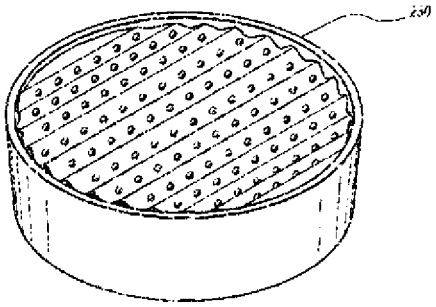

FIG. 3A

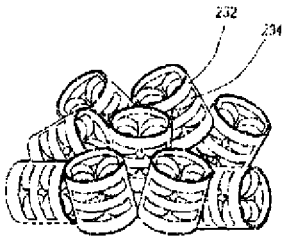

FIG. 3B

In the Specifications

Column 4

Line 38, change "FIGS 3 and 3B" to --FIGS 3A and 3B--

Line 41, change "illustrates" to --illustrate--

Column 5

Line 44, change "regenerating unit 1" to --regenerating unit 114--

Column 6

Line 19, change "and then into" to --and then moved into--

Line 38, change "vessel 224" to --vessel 224a--

Line 49, change "vessel 224" to --vessel 224a--

Signed and Sealed this
Sixth Day of May, 2014

Michelle K. Lee

Michelle K. Lee
*Deputy Director of the United States Patent and Trademark Office*

Column 7
Line 10, change "regions 233" to --regions 234--
Line 15, change "Fig. 4 shows slanted plates" to --Fig. 4A shows slanted plates--
Line 16, change "220d" to --220a--
Line 17, change "220e" to --220a--
Line 28, change "nozzles 233" to --nozzles 234--
Line 46, change "regeneration unit 14" to --regeneration unit 114--

Column 8
Line 12, change "essentially to low" to --essentially too low--
Line 30, change "FCC Units" to --FCC units--

Column 9
Line 37, change "1 seconds" to --1 second--

Column 10
Line 2, change "FCC Unit" to --FCC unit--

Column 11
Line 7, change "bottoms results" to --bottoms result--